US006721710B1

(12) United States Patent
Lueck et al.

(10) Patent No.: US 6,721,710 B1
(45) Date of Patent: Apr. 13, 2004

(54) METHOD AND APPARATUS FOR AUDIBLE FAST-FORWARD OR REVERSE OF COMPRESSED AUDIO CONTENT

(75) Inventors: Charles D. Lueck, Dallas, TX (US); Alec C. Robinson, Dallas, TX (US); Jonathan L. Rowlands, Somerville, MA (US)

(73) Assignee: Texas Instrument Incorporated, Dallas, TX (US)

( * ) Notice: Subject to any disclaimer, the term of this patent is extended or adjusted under 35 U.S.C. 154(b) by 510 days.

(21) Appl. No.: 09/690,528

(22) Filed: Oct. 17, 2000

Related U.S. Application Data

(60) Provisional application No. 60/170,449, filed on Dec. 13, 1999.

(51) Int. Cl.[7] ..... G10L 19/00

(52) U.S. Cl. ..... 704/500; 369/59.21

(58) Field of Search ..... 704/500, 211; 369/59.21, 30.06; 370/395.64; 714/775

(56) References Cited

U.S. PATENT DOCUMENTS 5,703,877 A * 12/1997 Nuber et al. ..... 370/395.64
5,828,995 A * 10/1998 Satyamurti et al. ..... 358/1.18
6,067,279 A * 5/2000 Fleming, III ..... 369/30.06
6,173,430 B1 * 1/2001 Massoudi ..... 714/775
6,377,530 B1 * 4/2002 Burrows ..... 369/59.21
6,421,647 B1 * 7/2002 Li ..... 704/500

* cited by examiner

*Primary Examiner*—Richemond Dorvil
*Assistant Examiner*—Kinari Patel
(74) *Attorney, Agent, or Firm*—Robert D. Marshall, Jr.; W. James Brady, III; Frederick J. Telecky, Jr.

(57) ABSTRACT

A method for performing audible fast-forward or reverse of audio content represented in a compressed format, such as, but not limited to, MPEG-1 Layer 3 (MP3) or MPEG-2 Advance Audio Coding (AAC) employs a fast-forward controller which performs fast-forward or reverse by repeatedly skipping forward or reverse in the compressed audio data stream, retrieving a block of data, and then splicing these data blocks back together. A decoder is then used to decode each of these blocks, to detect when a block switch has occurred (a splice in the data stream), and to quickly resynchronize at each transition. Hierarchical or multiplexed data streams may be decoded using a cascade of decoders each employing this technique. The decoder uses a robust sync search for performing resynchronization and error recovery.

9 Claims, 3 Drawing Sheets

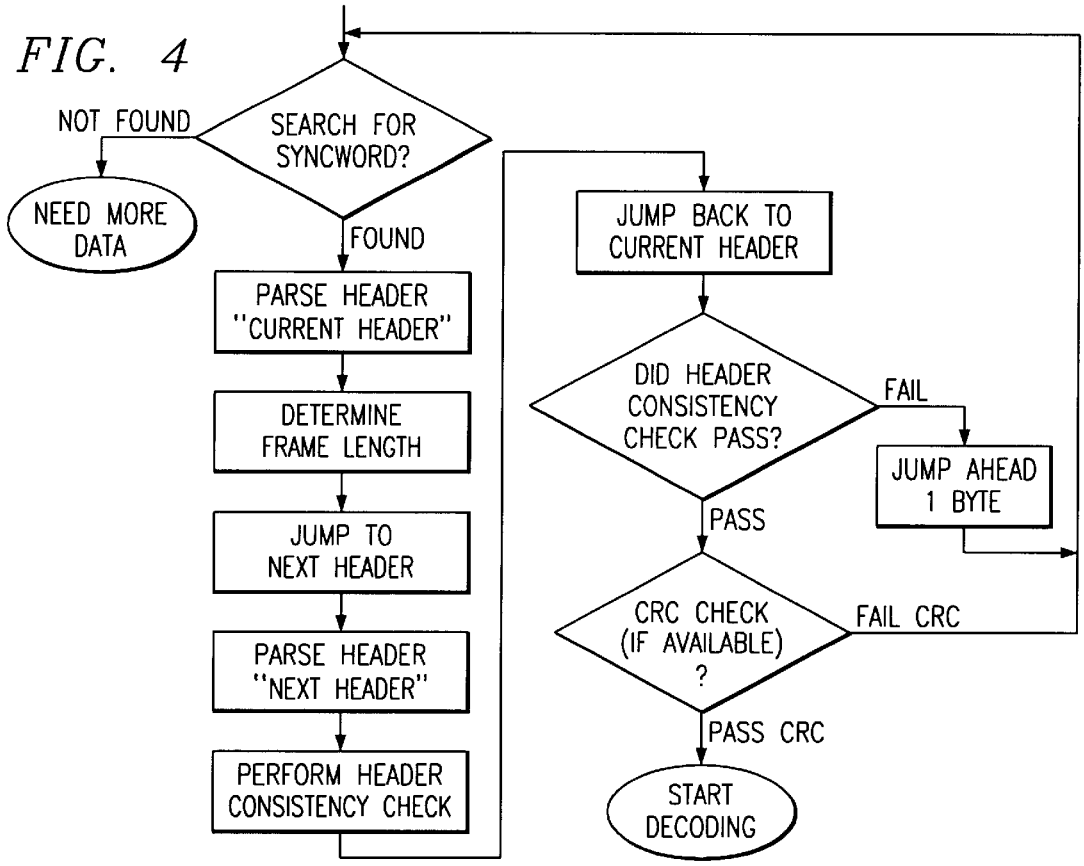
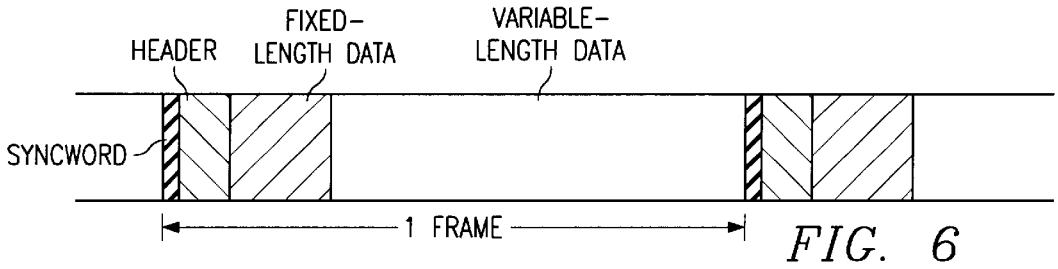
FIG. 6
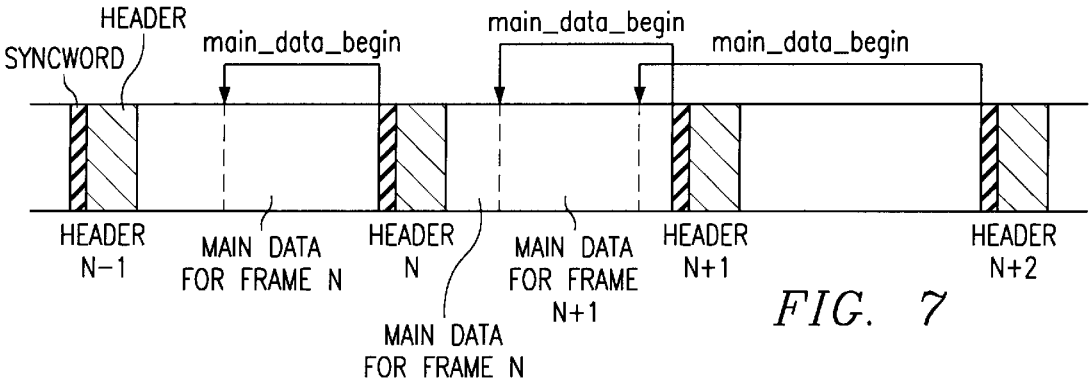
FIG. 7

METHOD AND APPARATUS FOR AUDIBLE FAST-FORWARD OR REVERSE OF COMPRESSED AUDIO CONTENT

This application claims priority under 35 USC §119(e)(1) of Provisional Application No. 60/170,449, filed Dec. 13, 1999.

TECHNICAL FIELD OF INVENTION

The present invention relates to method and apparatus for use of digital communications signals, and more particularly, to method and apparatus for audible fast-forward or reverse of compressed audio content.

BACKGROUND

Providing an audible fast-forward/reverse support for compressed audio formats is typically a challenge due to resynchronization issues associated with such formats. FIGS. 6 and 7 show the formats of a typical compressed audio data stream. The data stream is divided into units called frames. Each frame represents a segment of audio data which can be decoded. At the start of each frame is a header, which contains general information about the data stream, i.e., sampling rate, bit rate, profile, etc. The first word of the header is a syncword, which is a string of bits that identifies the "start" of a frame.

For current generation personal, digital audio players, the fast-forward and reverse functions are silent. That is, the user only hears silence during the fast-forward (or reverse) operation. A simple fast-forward technique involves jumping forward in the data stream by an amount associated with the desired fast-forward rate, and then re-synchronizing based on the frame headers. To do this resynchronization, a search may be employed which searches the data stream for the string of bits which matches a syncword. When this syncword is found, the decoder can begin parsing the frame. In addition, a cyclic redundancy check (CRC) can be used to detect errors in the data stream.

However, even this simple technique has many practical problems associated with it. Many compressed audio file formats, such as MPEG-1 Layer 3 (MP3) or MPEG-2 AAC, utilize large amounts of variable length coding. Certain allowable sequences of these variable length codes can actually emulate the syncword, i.e., the syncword is not unique. It is a common occurrence to find a match to a "false" syncword when searching in such a data stream.

In addition, the CRC check is typically not required, and is therefore not always transmitted. When it is transmitted, significant parsing and/or computation may be required to determine the validity of the frame. In some audio transports, a 1-bit field is used to indicate whether the CRC is used. Parsing a faulty header which has this bit set to 0 (caused by faulty syncword detection) may, in fact, cause the CRC check to be disabled.

Because of the use of variable-length codes, parsing errors can occur (and be decoded/played) undetected, since even random noise can sometimes be a valid sequence of codewords. This results in the output of the decoder being badly distorted.

Furthermore, in some audio data streams, such as those associated with MP3, the data required to decode the frame actually occurs before the syncword and header. A field in the header tells the decoder where to look for data. This pointer will always point backwards, and in some cases will even point to a location before the previous frame hear. When a break or discontinuity in the data stream occurs, resynchronization is difficult because, even though the header has been found, the data may not be complete.

Synchronization of hierarchical or multiplexed data streams poses an additional problem. In such data streams, an outer bitstream which may be encrypted carries pieces of an inner data stream as payload. This multiplexed data stream may be decoded by an outer decoder that extracts the payload data and supplies it to an inner decoder. Following a splice in the data stream, the outer decoder/decryptor must first gain synchronization, followed by the inner decoder. This compounds the difficulty of problems such as resynchronization time and error robustness.

SUMMARY

The present invention provides a method and apparatus for audible fast-forward or reverse of compressed audio content.

The present invention provides a method for performing audible fast-forward/reverse of audio content represented in a compressed format, such as, but not limited to, MPEG-1 Layer 3 (MP3) or MPEG-2 Advance Audio Coding (AAC). A fast-forward controller is employed which performs fast-forward or reverse by repeatedly skipping forward or reverse in a stored compressed audio data stream, retrieves a chunk of data, and then stores these data chunks in an end-to-end fashion, such that they are spliced back together as a single data stream. A decoder is then used to decode each of these chunks, to detect when a chunk switch has occurred (a splice in the data stream), and to quickly resynchronize at each transition. Hierarchical or multiplexed data streams may be decrypted and decoded using a cascade of decoders each employing this technique. The decoder uses a novel and robust syncword search for performing resynchronization and error recovery.

BRIEF DESCRIPTION OF DRAWINGS

For a more complete understanding of the present invention, and the advantages thereof, reference is now made to the following detailed description taken in conjunction with the accompanying drawings, in which:

FIG. 4 depicts a simplified flow diagram for one synchronizing method of the present invention;

FIG. 6 depicts a block diagram of a frame structure for an AAC audio format; and FIG. 7 depicts a block diagram of a frame structure for an MP3 audio format;

DETAILED DESCRIPTION

The present invention provides a method and apparatus for method and apparatus for audible fast-forward or reverse of compressed audio content.

Figure 1:
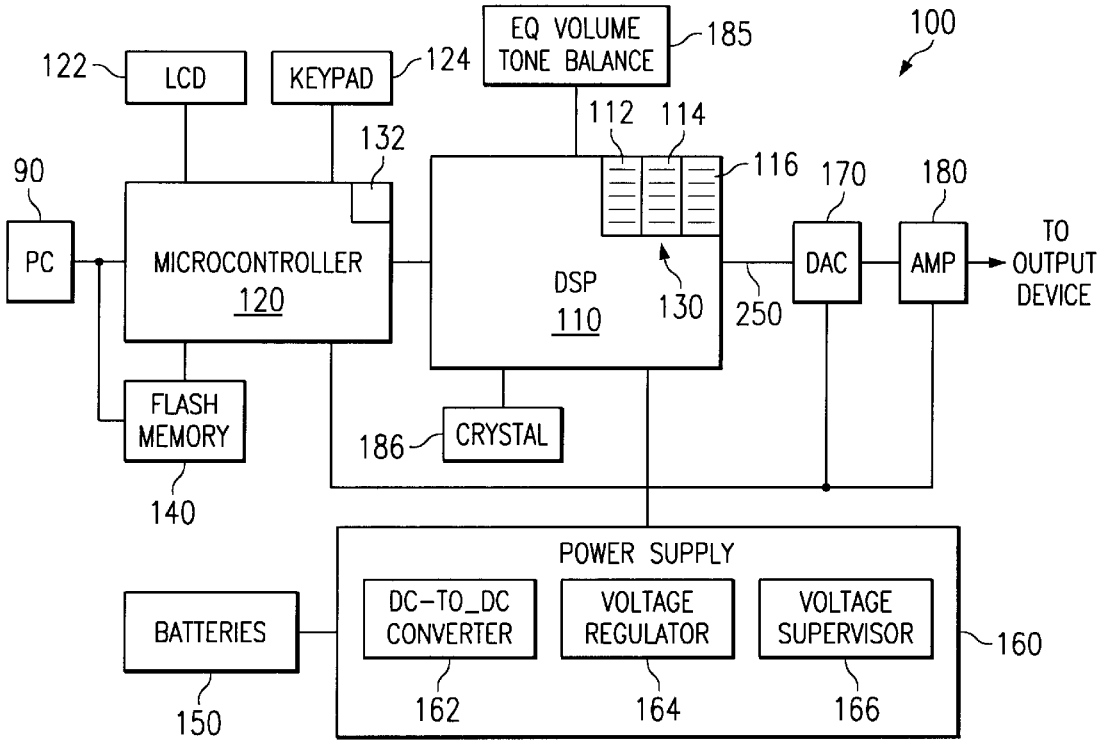
FIG. 1 depicts a block diagram of a hardware platform for playing digital audio files for an individual end user, e.g. a portable audio player, capable of implementing the methods of the present invention.

Referring now to FIG. 1, there may be seen a hardware platform or system 100 for playing digital audio files for an individual end user, e.g. a portable audio player. The digital audio files may be in various compressed and/or encoded formats. This platform 100 is contained within a suitable holder to allow for easy transport, operation, and replacement of stored audio files (audio content).

As may be seen from FIG. 1, the platform includes a digital signal processor (DSP) 110 and a microcontroller 120 that are interconnected. Typically, the DSP 110 executes a stored program 112, 114, or 116 for decoding and decompressing stored audio data files. The microcontroller 120 provides appropriate displays 122 and controls keypad 124 to allow the user to operate the platform. Both the microcontroller 120 and DSP 110 may include on-chip memory 132, 130 for storing the programs for operating the microcontroller 120 and DSP 110 to provide desired functionality for the portable audio player. The platform 100 also includes a flash memory 140, which is preferably removable, for storing the digital audio data.

The platform includes batteries 150, which are replaceable and/or rechargeable, that supply power for the other devices on the platform. There is a power supply block 160 associated with and connected to the batteries 150. The power supply block 160 includes a DC to DC converter 162 for converting the voltage of the batteries to those voltages required to operate the devices on the platform. A voltage regulator 164 may be provided to regulate selected voltages to a desired level of regulation. In addition, a voltage supervisor 166 may be provided as part of the power supply to oversee and control the operation of the DC to DC converter and voltage regulator. For ease of depiction purposes, FIG. 1 does not depict all the interconnections between the power supply and the devices in the platform 100.

The DSP 110 provides an audio bit stream to a stereo digital-to-analog (DAC) converter 170 which converts the digital signals to an analog equivalent. A power amplifier 180 is interconnected with the DAC 170 for amplifying the signal and providing the signal to an output device such as speakers, a set of earphones, or some other device for converting the electrical signal to an audible signal.

Preferably, the DSP 110 in addition to decoding also performs equalization, volume, tone, and balance control functions 185 responsive to control signals from the microcontroller as a result of user interactions with control keys in the keypad 124. Alternatively, the power amplifier may be responsive to control signals from the microcontroller 120 (or the DSP 120) for volume, tone, and balance control.

The platform preferably includes a crystal 186 for controlling the clock frequency for the DSP 110 and may include a separate crystal for controlling the clock frequency for the microcontroller 120. Alternatively, the DSP 110 may supply a clock signal to the microcontroller 120, or vice versa.

The flash memory 140 contains the audio files, e.g. audio content, available for listening to by the end user. The audio files are typically stored as separate files for each song, which may be in different audio formats, such as, for example, but not limited to MP3 and AAC. The flash memory 140 may also contain stored program files for decoding each type of audio format, as well as control other operations associated with the methods of the present invention. These files are typically stored with a file extension that identifies the format. Thus, a system controller may recognize the format of the next song desired to be played by the user and recognize that the decoder program currently loaded in local memory 130 associated with the DSP 110 may be of a different format; the system controller may then discard the program for the "old" decoder and reload local memory 130 of DSP 110 with the decoder program for the format of the file desired to be played. For each such data file stored in the flash memory 140, the audio data is typically stored as a continuous sequence of data in adjacent memory locations. Thus, the sequential data stream in memory may be accessed and retrieved for decoding and/or decryption by addressing the corresponding sequential memory address locations and retrieving data blocks of a size corresponding to the output data word width of the specific memory device employed for the flash memory 140.

An external personal computer (PC) 90 may be appropriately connected with the platform 100. In this manner, audio files may be loaded directly into memory 140 by the PC 90 or into memory 140 via the microcontroller 120. Alternatively, the PC 90 may be employed to load the audio files into memory 140 when it is removed from platform 100 and inserted into special hardware interconnected with the PC 90 for downloading audio files into the memory 140, via an appropriate interconnection for memory 140.

Figure 2:
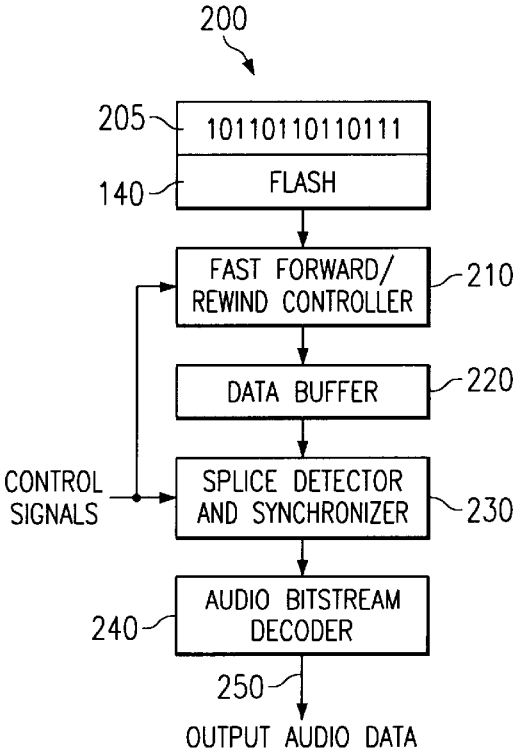
FIG. 2 depicts a high level block diagram of a software hierarchy suitable for use on the hardware platform of the present invention depicted in FIG. 1.

Referring now to FIG. 2, there may be seen a high level block diagram of a software hierarchy 200 suitable for implementing the invention of the present invention on the hardware platform 100 of Figure ore particularly, in FIG. 2 there may be seen a data stream 205 stored in the flash memory 140. A fast-forward controller 210 is a programmable address generator that moves the sequence of data from the memory to a temporary data buffer 220 when operating in "normal" playback mode. The fast-forward controller 210 also operates in a fast-forward mode in response to a user operation of an appropriate fast-forward (or reverse) control on the audio player.

When operating in a fast-forward mode, the fast-forward controller segments the sequential data stream into chunks of data (blocks of data) which are separated in time. The time separation between chunks is determined by the desired fast-forward rate. This rate is preferably adjustable and may be set or selected via software or other control signals. The fast-forward controller 210 is preferably implemented as a program and one that executes on the microcontroller 120; although, clearly, this program may also execute on the DSP 110. In any event, the fast-forward controller moves data from memory to the temporary data buffer 220.

The splice detector and synchronizer block 230 detects the transition between each of these chunks in a fast-forward (or reverse) mode, detects when a chunk switch has occurred (e.g. a splice in the data stream), and then quickly resynchronizes (e.g. finds a syncword and its associated header) after each splice. The splice detector and synchronizer block 230 maintains synchronization and performs resynchronization whenever a break or splice in the data stream occurs. The details for performing such a task are described later herein. Once the data stream is synchronized the data is passed to a decoder 240 which decodes the audio data and provides an output audio data stream 250.

Figure 3:
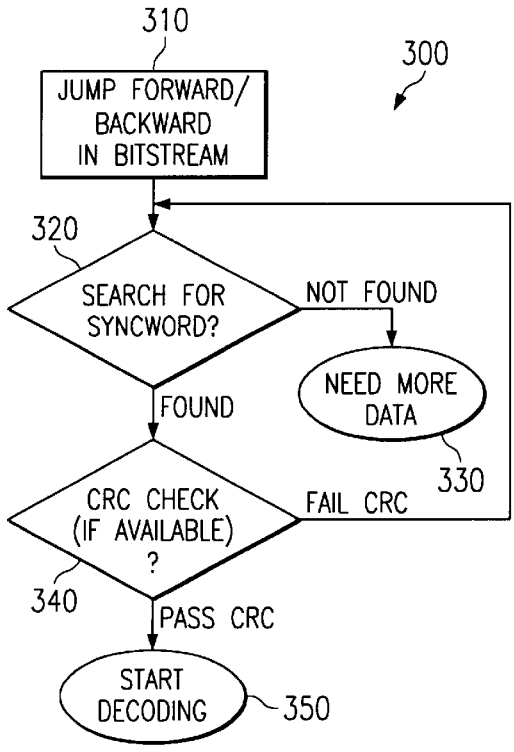
FIG. 3 depicts a simplified flow diagram of the fast-forward (or reverse) method of the present.

Referring now to FIG. 3, there may be seen a simplified flow diagram 300 for the fast-forward (or reverse) method of the present invention. More particularly, the fast-forward controller 210 jumps forwards (or backwards) in the data stream 310 stored in memory. A chunk of data is then forwarded to a temporary buffer 220. The fast-forward controller again jumps forwards and then forwards another chunk of data to the buffer. This continues in an ongoing fashion. The splice detector and synchronizer block 230 then searches for a syncword at block 320 in at least a portion of the first chunk of data in the buffer. If a syncword is not located, then additional data of the first chunk from the buffer is examined for a syncword at block 330. If a syncword is located, then the header is examined to determine if a CRC check is to be performed 340. If no CRC check is to be performed, the data is passed to the decoder 240 for decoding 350. If not, the CRC check is performed and evaluated against the provided checksum. If the CRC check is passed, then the data is made available to the decoder 240 for decoding 350 in accordance with the audio format of the data file. If the CRC check fails, then a new search is initiated for a syncword 320 to find another header.

Referring now to FIG. 4, there may be seen a simplified flow diagram for the synchronizing method of the present invention. More particularly, it may be seen from FIG. 4 that data from the temporary data buffer is initially searched or analyzed for a syncword. If a syncword is not detected more data is retrieved from the buffer to continue to look for a syncword. If a syncword is located, its associated header is parsed to determine several things. One determination is where the next syncword should be located in the data stream. Another determination is where the data associated with the header starts or is located. This is then used to determine the frame length. Additional determinations are made as to the sampling rate, bit rate, profile, layer, and identification fields.

Then a jump is then made to the next header via its corresponding syncword. The next header is then parsed to determine the same information noted above. The information from the two headers are then compared for consistency. In parallel with this consistency comparison a jump is made back to the first header. If the information from the two headers is consistent a check is then made of the need to perform a CRC check. If the information is inconsistent, the data from the data stream is advanced and the search for the first syncword and header begins again. In a similar manner, if the CRC check is performed and the checksum is not correct, then. the search for the first syncword and associated header begins again.

If the CRC check is passed, then the data is provided to the decoder. This type of double header search is especially useful for formats like those associated with the AAC format. The AAC frame format is depicted in FIG. 6. As may be seen from FIG. 6, the frame includes an initial syncword which is immediately followed by the header. The header in turn is followed by a portion of fixed length data. The fixed length data is followed by a packet of variable length data. As noted earlier herein, information about the length of the frame is included in the header.

FIG. 7 depicts the frame format for the MP3 audio format. Again there is a syncword followed immediately by header. However, for the MP3 format the data may be partially or entirely "in front" of the header. In FIG. 7, header N is in the "middle" of its associated data packet. Thus, the header N has a pointer to where its data starts (main data begin). However, until header N+1 is decoded it may not be certain where data for packet N ends and data for packet N+1 starts. Thus, there is often a need to evaluate two headers to determine the packet length. The remainder of FIG. 7 depicts the situation where 3 headers must be decoded to determine the packet length for packet N+2. Remember that a frame extends from one syncword to the next syncword, so that the data for a particular packet may span one or more frames.

Figure 5:
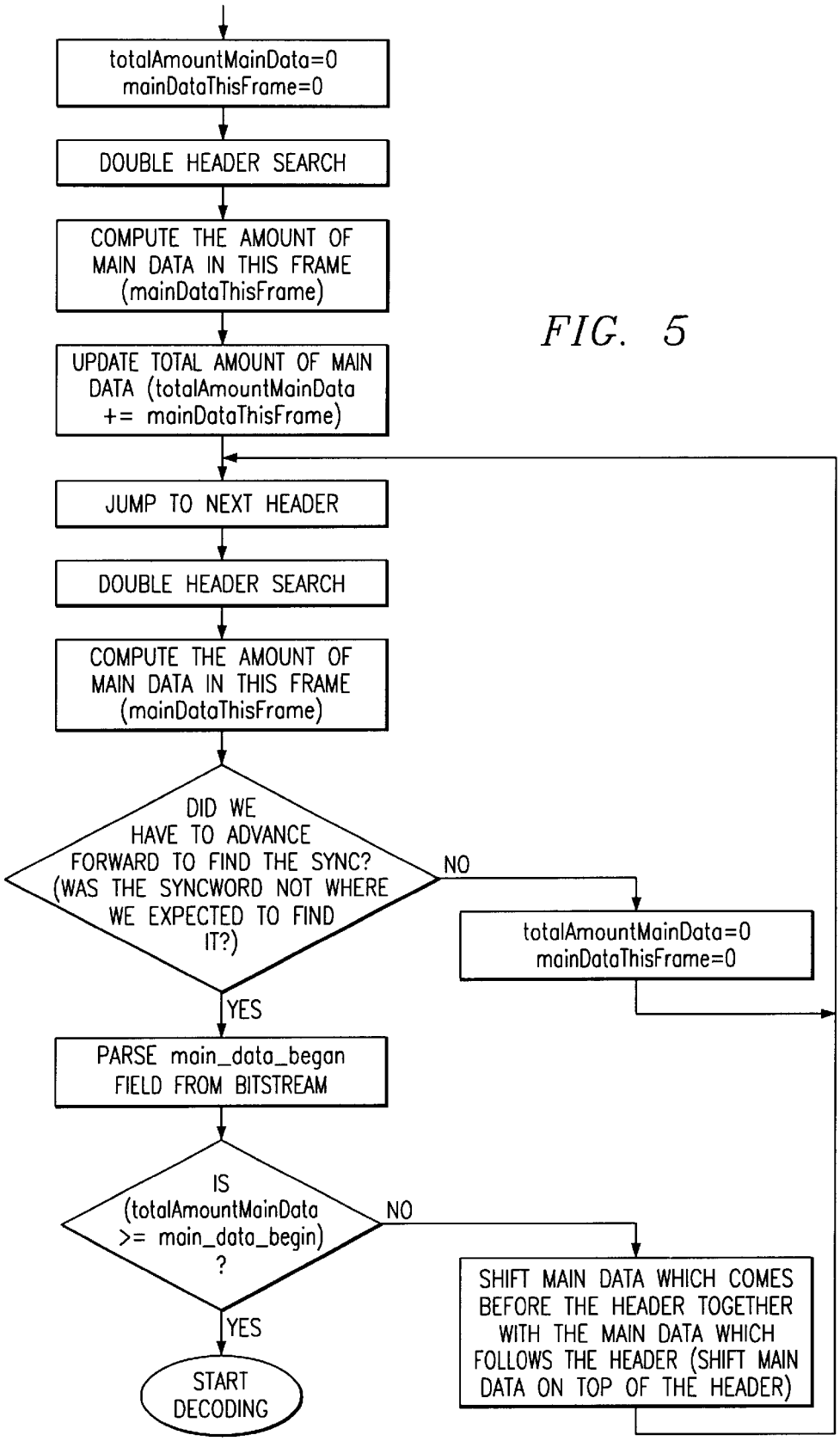
FIG. 5 depicts a simplified flow diagram for a synchronizing method of the present invention as applied to MP3 audio format.

Referring now to FIG. 5, there may be seen a simplified flow diagram for the synchronizing method of the present invention as modified for the MP3 format. The "totalamountMainData" is a variable that serves to capture the length of the data packet after adjustment for (deletion of) headers and syncwords. It is intialized to zero when first starting the syncword search. In a similar manner, the variable "mainDataThisFrame" stores the length of data in the frame under analysis or determination. FIG. 5 adds steps to determine these variables versus headers and frames.

For audio data that is encrypted an outer layer is added to the inner layer of data that needs to be decoded as noted earlier herein. These hierarchical or multiplexed data streams may be decrypted and decoded using a cascade of decoders each employing this technique.

For splice detection during resynchronization the invention requires that a "candidate" header frame correctly identify the location of the succeeding frame header. For the common case where input data stream data is delivered in sequence to the decoder, the data intervening between these two headers is stored in memory. In the case of a hierarchical data stream with large outer frames, this may impose an unacceptable increase in memory cost beyond what is required to decode the inner data stream. In addition, since the data stream is delivered at a finite data rate to the decoder, the increased memory may cause an increased delay before the outer decoder can make a decision, which may be perceptible in the decoded audio. A further aspect of the invention is a method to minimize the increase in memory and delay in the case of a hierarchical data stream. Details of the method are described later herein.

For hierarchical or multiplexed data streams, the syncword search for the outermost encrypted layer may be relaxed to a single syncword and associated header search. This is possible in situations were the encryption is weak in that the data immediately following the encrypted header is encrypted but most of the remaining data in the frame is not encrypted.

The present invention is capable of being implemented in software, hardware, or combinations of hardware and software. Although the present invention and its advantages have been described in detail, it should be understood that various changes, substitutions and alterations may be made herein without departing from the spirit and scope of the invention, as defined in the appended claims.

What is claimed is:

1. A method for providing an audible fast forward or reverse for an audio data file encoded in a compressed variable length format, comprising:

jumping forward or backward in the data file by a preselected amount, grabbing a data chunk whose length is at least a function of the sampling rate and bit rate, said data chunks for successive jumps separated in time, storing said data chunk, analyzing said stored data chunks including searching each data chunk for a first syncword and associated header, parsing said associated header of said syncword to determine a location for a next syncword and associated header, parsing said associated header of said next syncword to determine consistency with said associated header of said first syncword, if said associated header of said first syncword is consistent with said associated header of said next syncword, then selecting audio format data corresponding to said associated header of said first syncword, and if a first syncword is not found or if said associated header of said first syncword is inconsistent with said associated header of said next syncword, then selecting more of said audio format data and repeating said step of analyzing said stored data chunks, selectively decoding said selected audio format data, and playing said decoded selected audio format data.

2. Apparatus for providing an audible fast forward or reverse for an audio data file encoded in a compressed variable length format, comprising:

fast-forward controller for repeatedly skipping forward or reverse in a compressed audio data stream, retrieving a block of data, and then splicing these data blocks back together, and decoder for decoding each data block, detecting when a block switch has occurred (a splice in the data stream), and re-synchronizing at each transition, said decoder operative to search each data block for a first syncword and associated header, parse said associated header of said syncword to determine a location for a next syncword and associated header, parse said associated header of said next syncword to determine consistency with said associated header of said first syncword, if said associated header of said first syncword is consistent with said associated header of said next syncword, then select audio format data corresponding to said associated header of said first syncword, and if a first syncword is not found or if said associated header of said first syncword is inconsistent with said associated header of said next syncword, then select more of said audio format data within said data block and search for a first syncword and associated header.

3. The method of claim 1, wherein:

said compressed variable length format consists of MPEG-1 Layer 3 (MP3).

4. The method of claim 1, wherein:

said compressed variable length format consists of MPEG-2 Advance Audio Coding (ACC).

5. The method of claim 1, wherein:

said step of jumping forward or backward in the data file by a preselected amount selects said preselected amount corresponding to a desired fast forward or backward rate.

6. The method of claim 1, wherein:

said step of analyzing said stored data chunks further includes performing a cyclic redundancy check on said selected audio format data, and if said cyclic redundancy check fails, then selecting more of said audio format data and repeating said step of analyzing said stored data chunks.

7. The method of claim 1, wherein:

said step of analyzing said stored data chunks further includes parsing said associated header of said syncword to determine if a cyclic redundancy check is indicated for said selected audio format data, if a cyclic redundancy check is indicated for said selected audio format data, performing a cyclic redundancy check on said selected audio format data, and if said cyclic redundancy check fails, then selecting more of said audio format data and repeating said step of analyzing said stored data chunks.

8. The apparatus of claim 2, wherein:

said fast forward controller skips forward or backward in the audio data stream by a preselected amount selects said preselected amount corresponding to a desired fast forward or backward rate.

9. The apparatus of claim 2, wherein:

said decoder further operative to perform a cyclic redundancy check on said selected audio format data, and if said cyclic redundancy check fails, then select more of said audio format data and search for a first syncword and associated header.

* * * * *